US007704098B2

(12) United States Patent
Lambie et al.

(10) Patent No.: US 7,704,098 B2
(45) Date of Patent: Apr. 27, 2010

(54) REGISTERED JACK WITH ENHANCED EMI PROTECTION

(75) Inventors: Kent Lambie, Brooklin (CA); Jeff Ouyang, Hetian Town (CN)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/177,465

(22) Filed: Jul. 22, 2008

(65) Prior Publication Data

US 2010/0022131 A1 Jan. 28, 2010

(51) Int. Cl.
*H01R 13/648* (2006.01)

(52) U.S. Cl. ..... 439/607.28; 439/939

(58) Field of Classification Search ..... 439/607.05, 439/607.04, 607.14, 607.26–607.28, 607.3, 439/607.38, 532, 404, 939
See application file for complete search history.

(56) References Cited

U.S. PATENT DOCUMENTS 5,766,041 A 6/1998 Morin et al.
5,788,538 A * 8/1998 Belopolsky et al. .... 439/607.38
5,989,069 A 11/1999 Tan et al.
6,257,935 B1 7/2001 Zhang et al.
6,283,796 B1 9/2001 Yeh
6,319,064 B1 11/2001 Belopolsky et al.
6,319,070 B1 11/2001 Tan et al.
6,328,599 B1 12/2001 Marshall et al.
6,328,603 B1 12/2001 Chang et al.
6,334,787 B1 1/2002 Chang et al.
6,431,819 B1 8/2002 Hahn
6,450,837 B1 9/2002 Givens et al.
6,478,611 B1 11/2002 Hyland
6,544,076 B2 4/2003 Pocrass
6,558,203 B2 5/2003 Pocrass
6,568,965 B2 5/2003 Pocrass
6,592,397 B2 7/2003 Pocrass
6,595,805 B2 7/2003 Pocrass
6,623,306 B2 9/2003 Xu et al.
6,638,112 B1 10/2003 Walker et al.
6,702,618 B1 3/2004 Hyland et al.
6,752,664 B2 6/2004 Hyland et al.
6,881,096 B2 4/2005 Brown et al.
6,918,790 B2 7/2005 Wan et al.
6,918,791 B2 7/2005 Wan et al.
7,018,242 B2 3/2006 Brown et al.
7,090,535 B2 8/2006 Wan et al.
7,309,260 B2 12/2007 Brower et al.
7,452,216 B2 * 11/2008 Murr et al. ..... 439/74
2001/0046807 A1 11/2001 Marshall et al.

(Continued)

*Primary Examiner*—Neil Abrams
*Assistant Examiner*—Phuong Nguyen
(74) *Attorney, Agent, or Firm*—Blank Rome LLP

(57) ABSTRACT

An electrical connector has a shield for EMI shielding. The top of the shield has two rows of tabs; two flaps, one on either side of the shield; and a tab on the bottom. The flaps have mounting holes. When the connector is attached to a mounting panel, screws or rivets are mounted through the holes in the flaps and corresponding holes in the mounting panel to secure the connector. The bottom tab and the two rows of top tabs electrically connect the shield to the mounting panel to provide extra EMI protection to the connector. The flaps provide yet another connection to provide EMI protection. The two rows of tabs can be positioned and sized such that the rear row of tabs engages with a flange in the rear of the top of the mounting panel. The electrical connector is preferably an RJ connector.

6 Claims, 7 Drawing Sheets

U.S. PATENT DOCUMENTS

2003/0082954 A1 5/2003 Espenshade et al.
2005/0186853 A1 8/2005 Hsu et al.
2007/0049072 A1* 3/2007 Sato ..... 439/79
2007/0270044 A1 11/2007 Belopolsky et al.
2008/0171468 A1* 7/2008 Briant et al. ..... 439/607
2008/0242127 A1* 10/2008 Murr et al. ..... 439/79

* cited by examiner

REGISTERED JACK WITH ENHANCED EMI PROTECTION

FIELD OF THE INVENTION

The present invention is directed to a registered jack (RJ) electrical connector and more specifically to an RJ connector having contacts to provide an electrical connection to a mounting frame to provide improved EMI protection.

DESCRIPTION OF RELATED ART

A registered jack (RJ) is a standardized physical interface for connecting telecommunications equipment (commonly, a telephone jack) or computer networking equipment. The standard designs for these connectors and their wiring are named RJ11, RJ14, RJ45, etc. These interface standards are most commonly used in North America, though some interfaces are used world-wide.

An RJ connector is typically configured to receive a plug that is formed generally as a rectangular solid, with contacts on one side and a latch on the opposite side, the latch being formed integrally with the rectangular solid out of a deformable plastic. The jack has contacts to connect with those in the plug and a slot adapted to engage the latch. A user can insert or remove the plug by applying pressure on the latch to deform it and remove it from the slot.

Registered jacks, like electrical and electronic equipment in general, are susceptible to electromagnetic interference (EMI), which is a (usually undesirable) disturbance that affects an electrical circuit due to electromagnetic radiation emitted from an external source. The disturbance may interrupt, obstruct, or otherwise degrade or limit the effective performance of the circuit. To mitigate the effects of EMI, it is common to use electromagnetic shielding, such as an enclosure formed of a conductive material.

An example of a connector with electromagnetic shielding is shown in U.S. Pat. No. 5,865,646 to Ortega et al. A high speed, low impedance shielded connector has a shield formed of sheet material and including multiple integral shield-to-plug contacts in a limited longitudinal space. Such contacts are forwardly facing, to reduce ground path lengths or are arranged substantially parallel to a plug insertion axis, to avoid development of high normal forces. Shielding of an array of contacts is enhanced by the use of transverse flanges having interfitting sections that provide effective shielding and allow close spacing or adjacent contacts in the array.

However, it would be desirable to increase the electromagnetic shielding still further.

SUMMARY OF THE INVENTION

It is therefore an object of the invention to provide improved EMI shielding for an RJ connector or the like.

To achieve the above and other objects, the present invention is directed to an electrical connector having a shield. The top of the shield has two rows of tabs; two flaps, one on either side of the shield; and a tab on the bottom. The flaps have mounting holes. When the connector is attached to a mounting panel, screws are driven through the holes in the flaps and corresponding holes in the mounting panel to secure the connector. The bottom tab and the two rows of top tabs electrically connect the shield to the mounting panel to provide extra EMI protection to the connector. The flaps provide yet another connection to provide EMI protection. The two rows of tabs can be positioned and sized such that the rear row of tabs engages with a flange in the rear of the top of the mounting panel.

BRIEF DESCRIPTION OF THE DRAWINGS

A preferred embodiment of the present invention will be set forth in detail with reference to the drawings, in which.

DETAILED DESCRIPTION OF THE PREFERRED EMBODIMENT

Figure 1A:
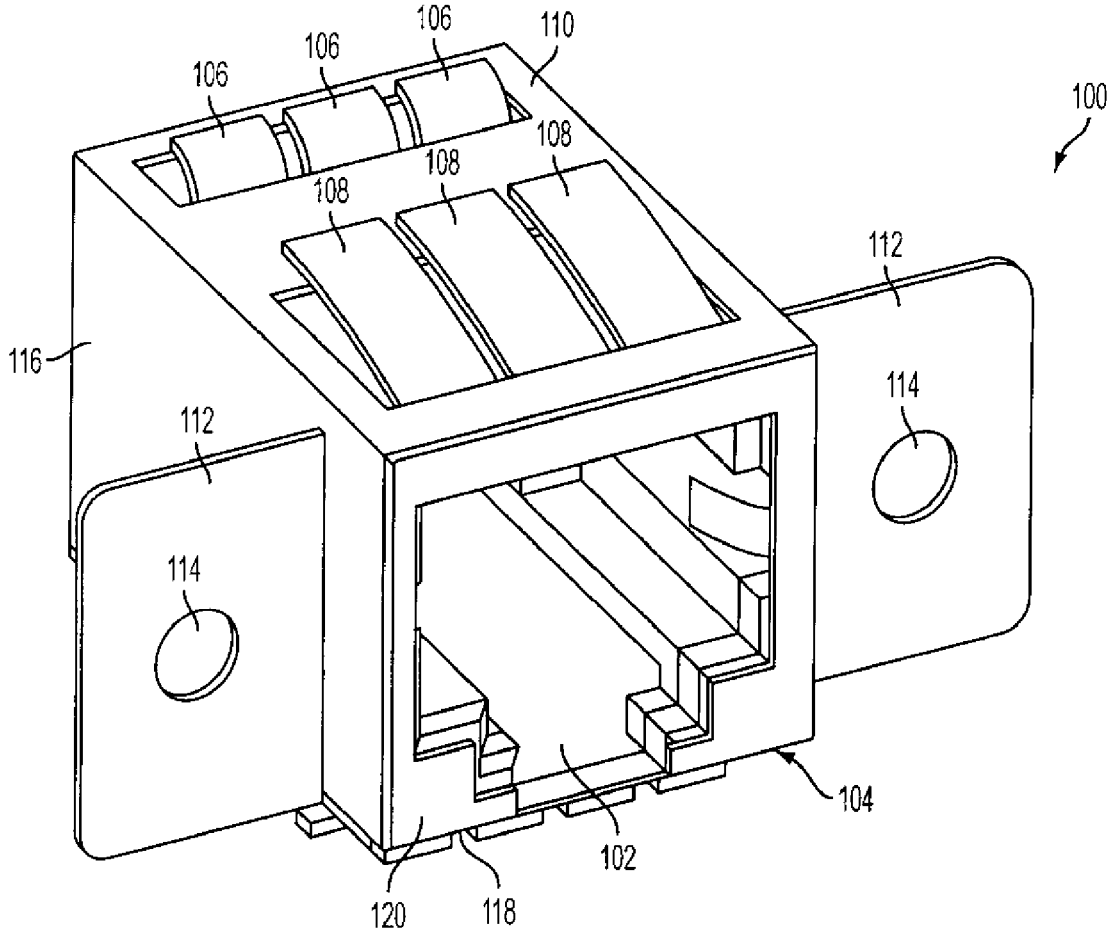
FIGS. 1A-1C are views of a connector according to the preferred embodiment.

A preferred embodiment of the present invention will be set forth in detail with reference to the drawings, in which like reference numerals refer to like elements or steps throughout.

Figure 1B:
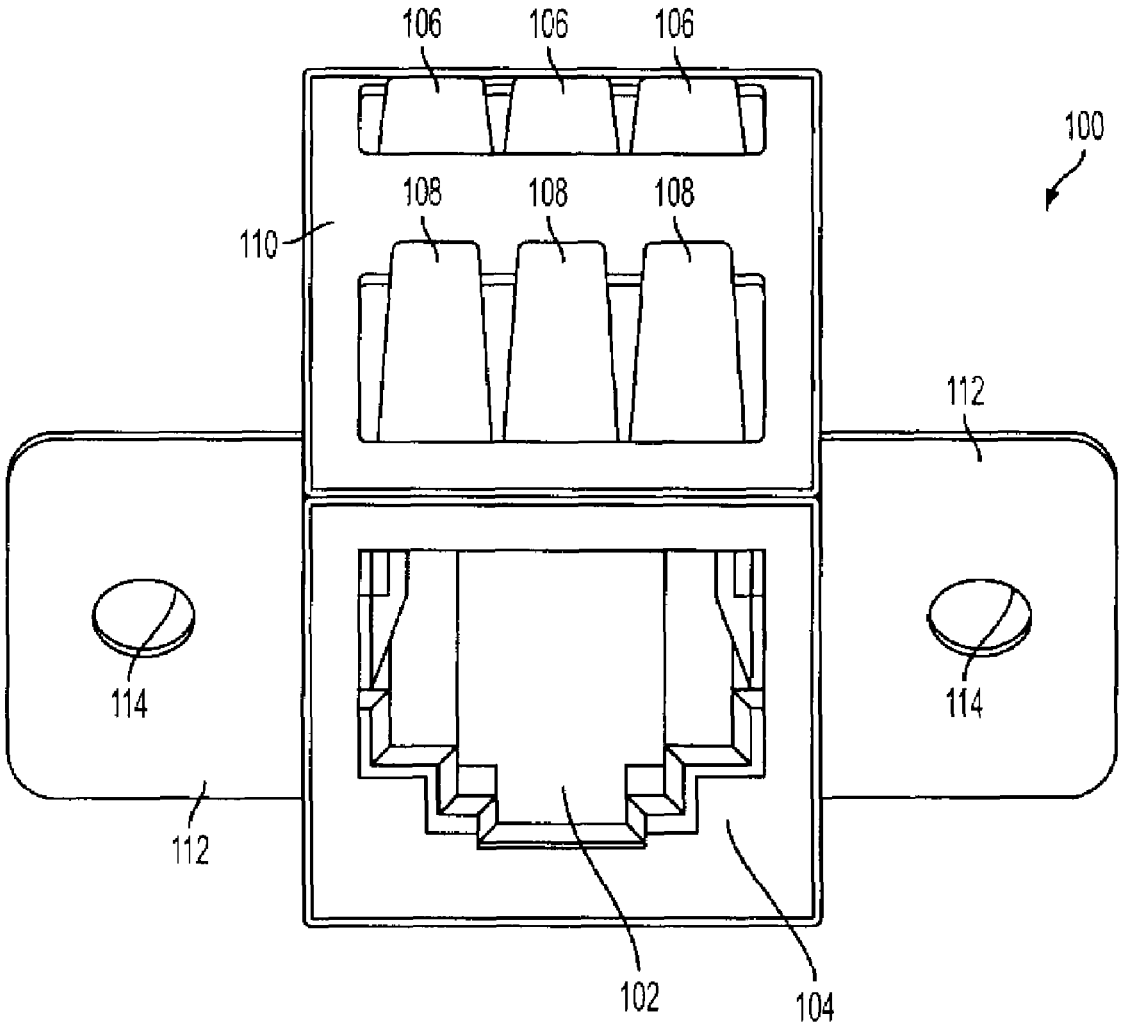
Figure 1C:
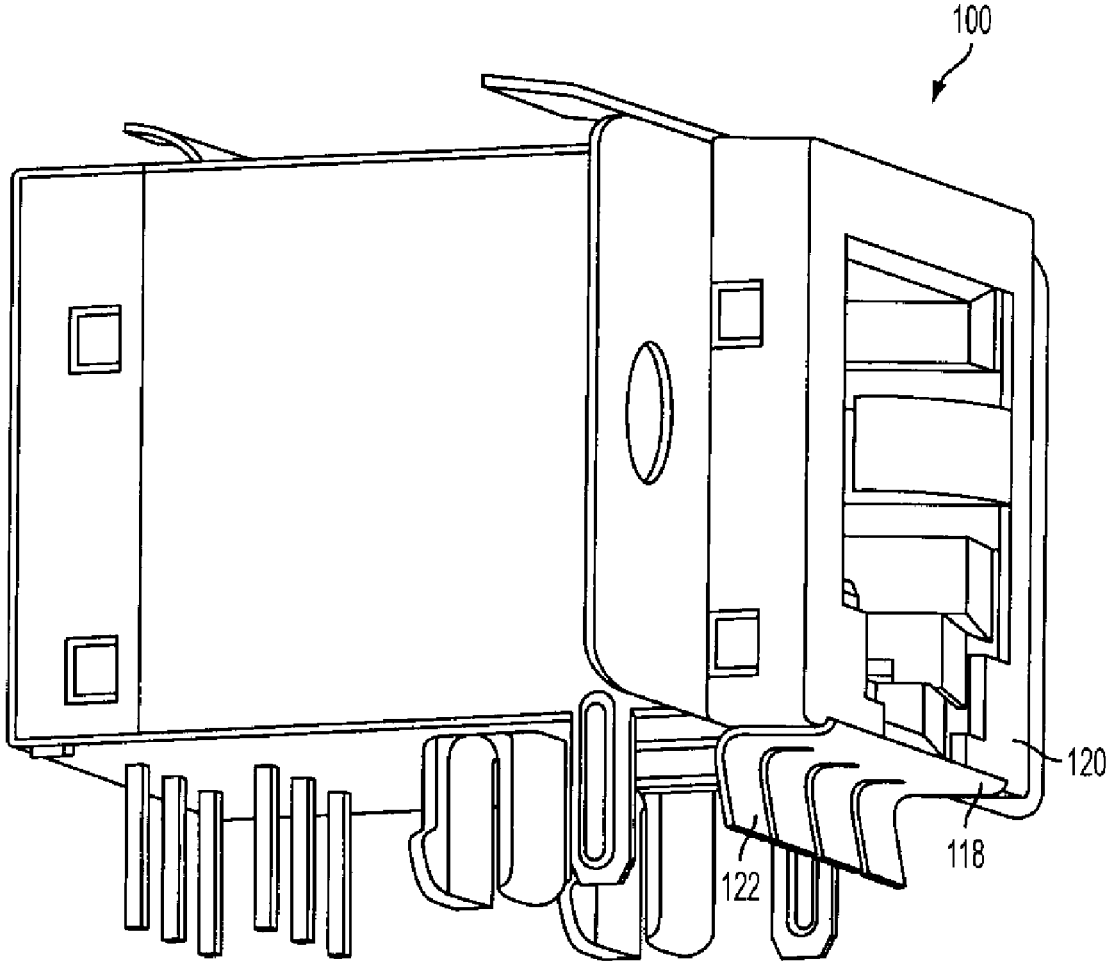

FIGS. 1A-1C show three perspective views of electrical connector 100 according to the preferred embodiment. The connector has a connector body 102 made of plastic or another dielectric material enclosed in a conductive shield 104, preferably formed of metal. Two rows of tabs 106, 108 are formed from the top 110 of the shield 104. The shield 104 has two flaps 112, each with a hole 114 to be used as explained below, extending from the sides 116 of the shield 104. The lower edge 118 of the front 120 of the shield 104 has tabs 122 extending down therefrom.

Preferably, the connector body 102 is formed of an engineering thermoplastic. The shield 104 is preferably formed of a copper alloy plated with nickel, with the tabs 122 dipped in pure tin. However, other non-conductive materials can be used to form connector body 102 and other conductive materials can be used to form the shield 104.

The connector 100 can include any suitable electrical contacts, which are well known in the art and will therefore not be disclosed in detail here.

Figure 2:
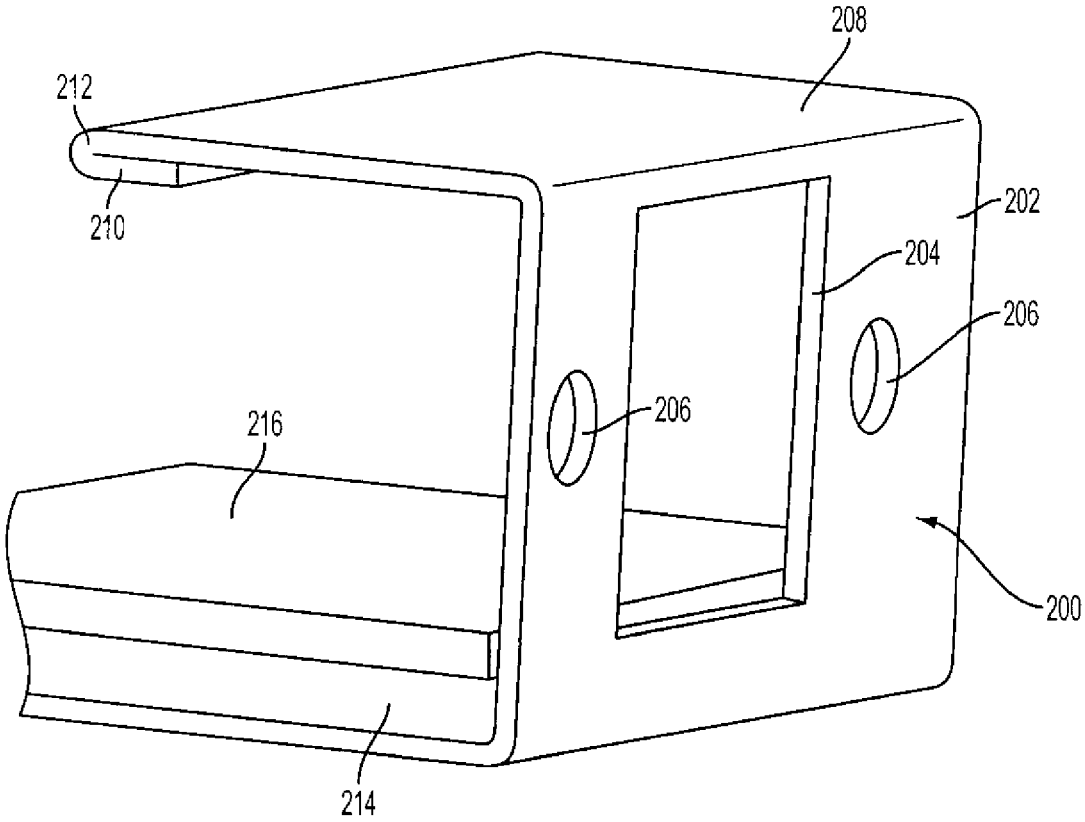
FIG. 2 shows a mounting panel for use with the connector of FIGS. 1A-1C.

FIG. 2 shows a perspective view of a mounting panel 200 for use with the connector 100. The mounting panel 200 is formed of metal or other conducting material and has an upright portion 202 having formed therein a socket hole 204 for receiving a plug and additional holes 206 on either side of the socket hole 204 for receiving a screw, rivet, or other fastening means. A top portion 208 of the mounting panel 200 has a flange 210 formed by folding back a rear edge 212 thereof. A bottom portion 214 is also provided. A printed circuit board 216 is contained within the mounting panel.

Figure 3:
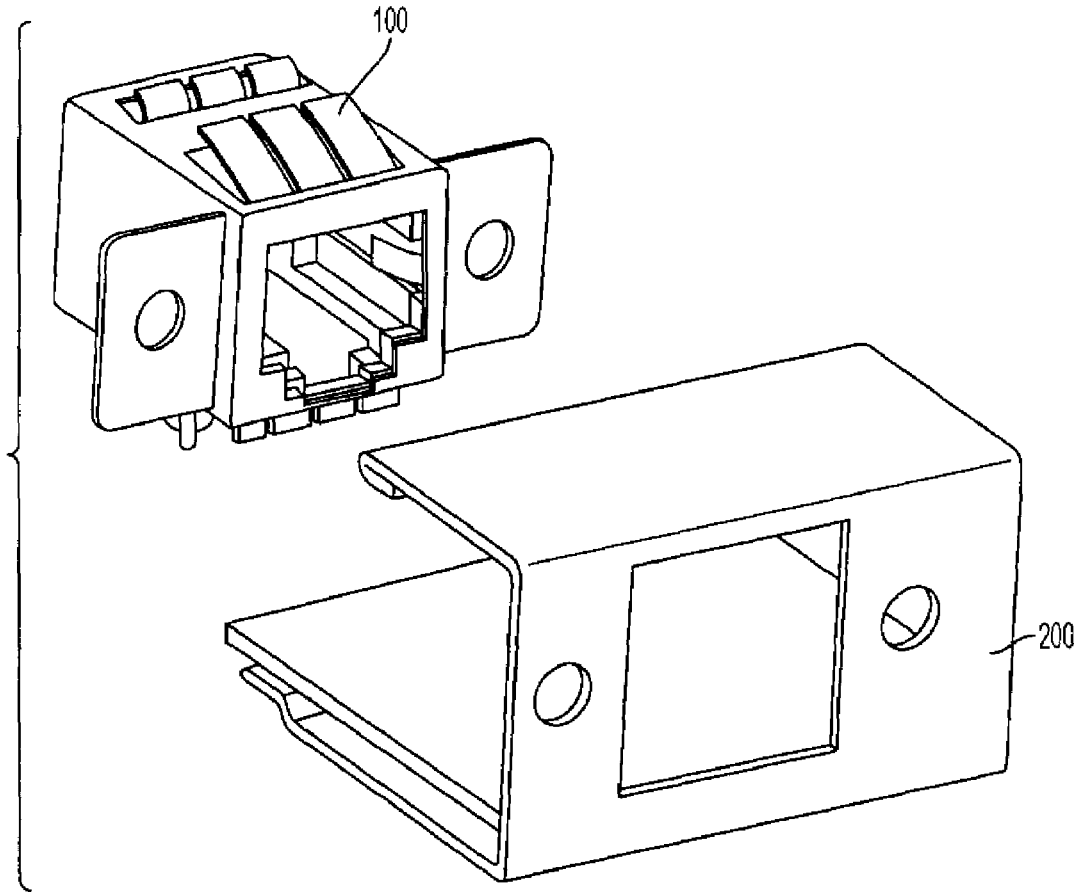
FIG. 3 shows the connector of FIGS. 1A-1C and mounting panel of FIG. 2 prior to insertion of the connector into the panel.
Figure 4B:
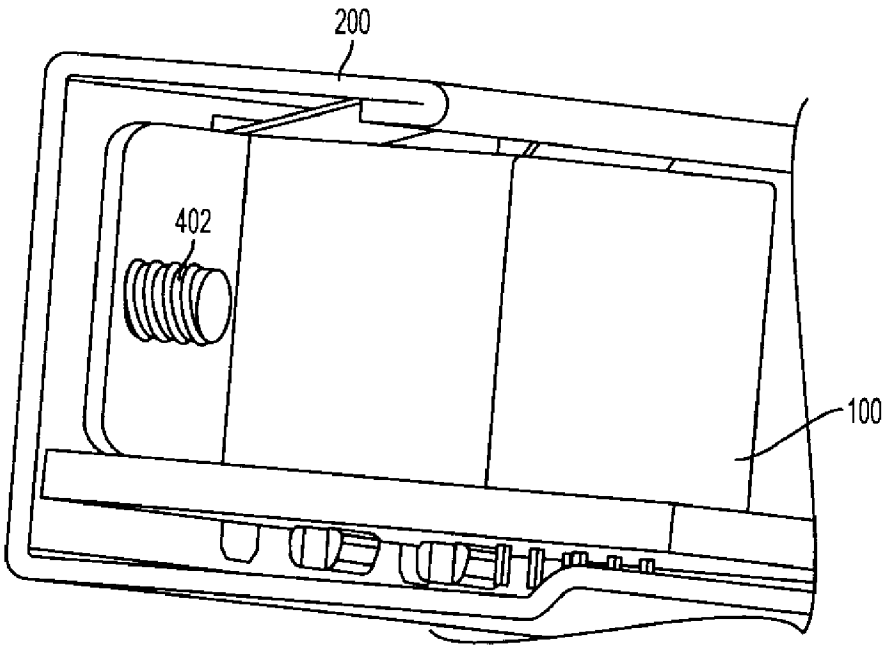
FIGS. 4A-4C are views of the connector and the mounting panel as finally assembled with the connector inserted into the panel.
Figure 4A:
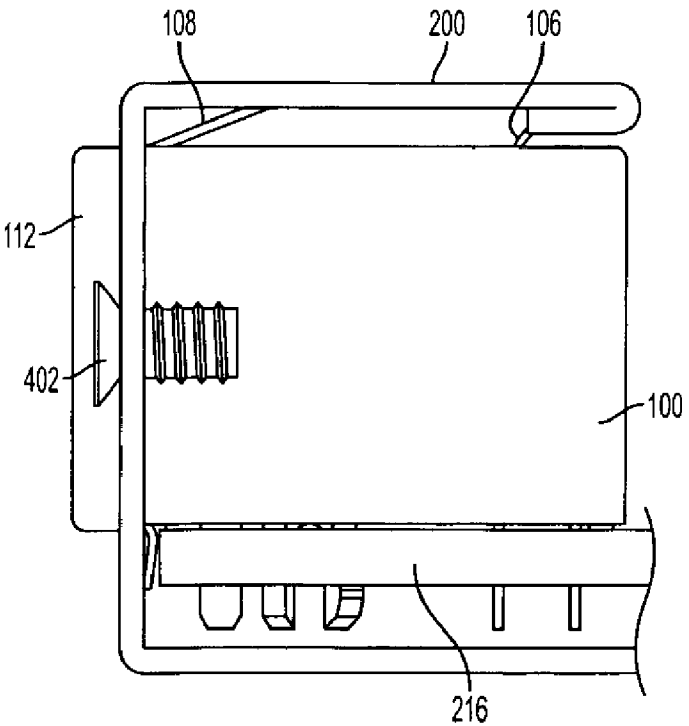
Figure 4C:
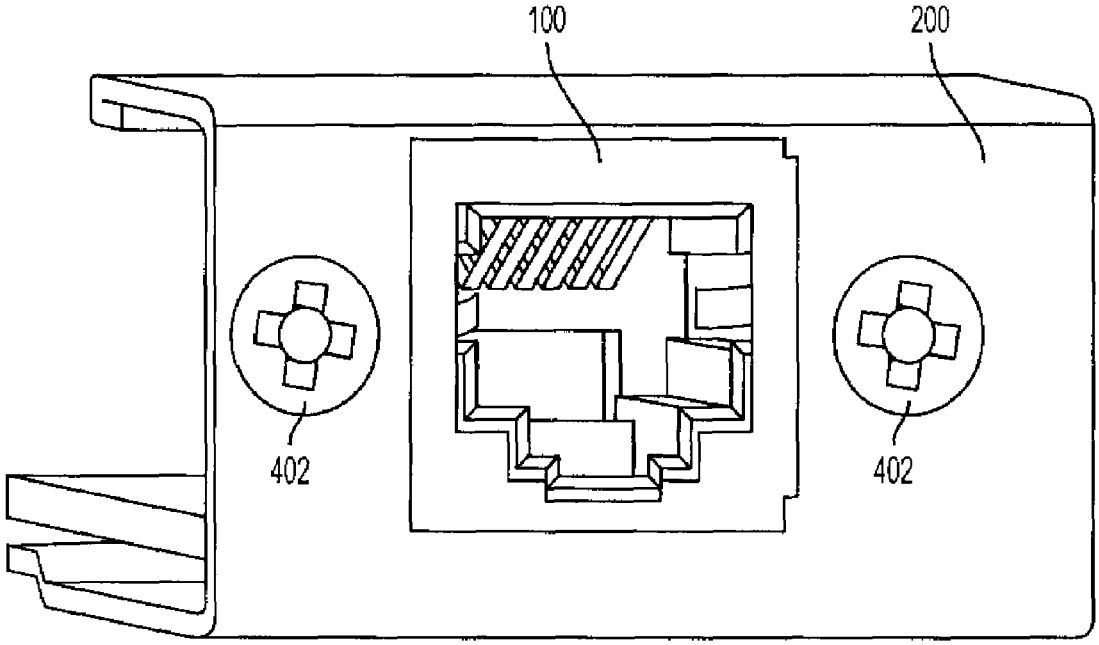

The manner in which the connector 100 and the mounting panel 200 are joined together will be explained with reference to FIGS. 3 and 4A-4C. As shown in FIG. 3, the connector 100 is inserted into the mounting frame 200 from behind. Once that is done, as shown in FIGS. 4A-4C, screws, bolts rivets or other fastening means 402 are used to secure the flaps 112 of the connector 100 to the upright portion 202 of the mounting panel 200 through holes 114, 206. When assembled in this fashion, the shield 104 is in electrical contact with the mounting frame 200 in the following ways to provide EMI shielding. The tabs 122 and the flaps 112 contact the upright portion 202, and the tabs 106, 108 contact the top portion. In a preferable embodiment, the rear tabs 106 engage with the flange 210.

While a preferred embodiment of the present invention has been set forth above, those skilled in the art who have reviewed the present disclosure will readily appreciate that other embodiments are possible within the scope of the invention. For example, whenever a row of three tabs is shown, more or fewer tabs can be used instead. Also, recitations of materials are illustrative rather than limiting. Therefore, the present invention should be construed as limited only by the appended claims.

What is claimed is:

1. An electrical connector that is shielded against electromagnetic interference when attached to a mounting panel, the connector comprising:

a connector body; and a shield surrounding the connector body, the shield being formed of an electrically conductive material and comprising:

a plurality of rows of tabs extending upwardly from an upper surface of the shield for making electrical contact with an upper portion of the mounting panel;

a plurality of flaps extending from a front surface of the shield for securing the shield to the mounting panel and also for making electrical contact with the mounting panel; and at least one tab extending downwardly from the shield for making electrical contact with the mounting panel.

2. The electrical connector of claim 1, wherein each of the flaps has a mounting hole formed therein.

3. The electrical connector of claim 1, wherein, in the plurality of rows of tabs, one of the rows of tabs is configured to engage with a flange formed in the mounting panel.

4. An assembly comprising:

a mounting panel comprising an upper portion; and an electrical connector attached to the mounting panel, the electrical connector being shielded against electromagnetic interference when attached to the mounting panel, the connector comprising:

a connector body; and a shield surrounding the connector body, the shield being formed of an electrically conductive material and comprising:

a plurality of rows of tabs extending upwardly from an upper surface of the shield for making electrical contact with the upper portion of the mounting panel;

a plurality of flaps extending from a front surface of the shield for securing the shield to the mounting panel and also for making electrical contact with the mounting panel; and at least one tab extending downwardly from the shield for making electrical contact with the mounting panel.

5. The assembly of claim 4, wherein each of the flaps has a mounting hole formed therein, and wherein the mounting panel has mounting holes formed therein corresponding to the mounting holes in the flaps.

6. The assembly of claim 4, wherein the upper portion of the mounting panel has a flanged formed therein, and wherein, in the plurality of rows of tabs, one of the rows of tabs is configured to engage with the flange.

* * * * *